US010261455B2

(12) United States Patent
Hamatsu

(10) Patent No.: US 10,261,455 B2
(45) Date of Patent: Apr. 16, 2019

(54) IMAGE FORMING APPARATUS AND NON-TRANSITORY COMPUTER READABLE MEDIUM

(71) Applicant: FUJI XEROX CO., LTD., Tokyo (JP)

(72) Inventor: Makoto Hamatsu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/817,289

(22) Filed: Nov. 20, 2017

(65) Prior Publication Data

US 2018/0217548 A1 Aug. 2, 2018

(30) Foreign Application Priority Data

Feb. 1, 2017 (JP) ..... 2017-016603

(51) Int. Cl.
*G03G 15/00* (2006.01)
*G03G 15/01* (2006.01)

(52) U.S. Cl.
CPC ..... *G03G 15/5062* (2013.01); *G03G 15/6523* (2013.01); *G03G 15/01* (2013.01)

(58) Field of Classification Search
CPC ..... G03G 15/5062; G03G 15/6517; G03G 15/6523; G03G 15/01; G03G 2215/00067; G03G 2215/00455
USPC ..... 399/15, 384, 407
See application file for complete search history.

(56) References Cited

U.S. PATENT DOCUMENTS

2004/0184853 A1* 9/2004 Matsuzaka ..... G03G 15/231 399/394
2012/0070160 A1* 3/2012 Aoki ..... G03G 15/5029 399/16
2012/0262510 A1* 10/2012 Komazawa ..... B41J 2/16526 347/9
2015/0071671 A1* 3/2015 Kiuchi ..... G03G 15/5062 399/72

FOREIGN PATENT DOCUMENTS

JP 2008-114485 5/2008

* cited by examiner

*Primary Examiner* — Sophia S Chen
(74) *Attorney, Agent, or Firm* — JCIPRNET

(57) ABSTRACT

An image forming apparatus includes an image forming section, a post-processing unit, and a controller. The image forming section forms an image on a recording medium. The post-processing unit processes the recording medium obtained after the image forming section forms the image. The controller controls a post-processing execution time of the post-processing unit on the basis of information obtained by reading at least one control pattern from the recording medium. The at least one control pattern is formed to control the image forming section.

20 Claims, 13 Drawing Sheets

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2017-016603 filed Feb. 1, 2017.

BACKGROUND

Technical Field

The present invention relates to an image forming apparatus and a non-transitory computer readable medium.

SUMMARY

According to an aspect of the invention, there is provided an image forming apparatus including an image forming section, a post-processing unit, and a controller. The image forming section forms an image on a recording medium. The post-processing unit processes the recording medium obtained after the image forming section forms the image. The controller controls a post-processing execution time of the post-processing unit on the basis of information obtained by reading at least one control pattern from the recording medium. The at least one control pattern is formed to control the image forming section.

BRIEF DESCRIPTION OF THE DRAWINGS

Exemplary embodiment of the present invention will be described in detail based on the following figures, wherein.

DETAILED DESCRIPTION

Figure 1:
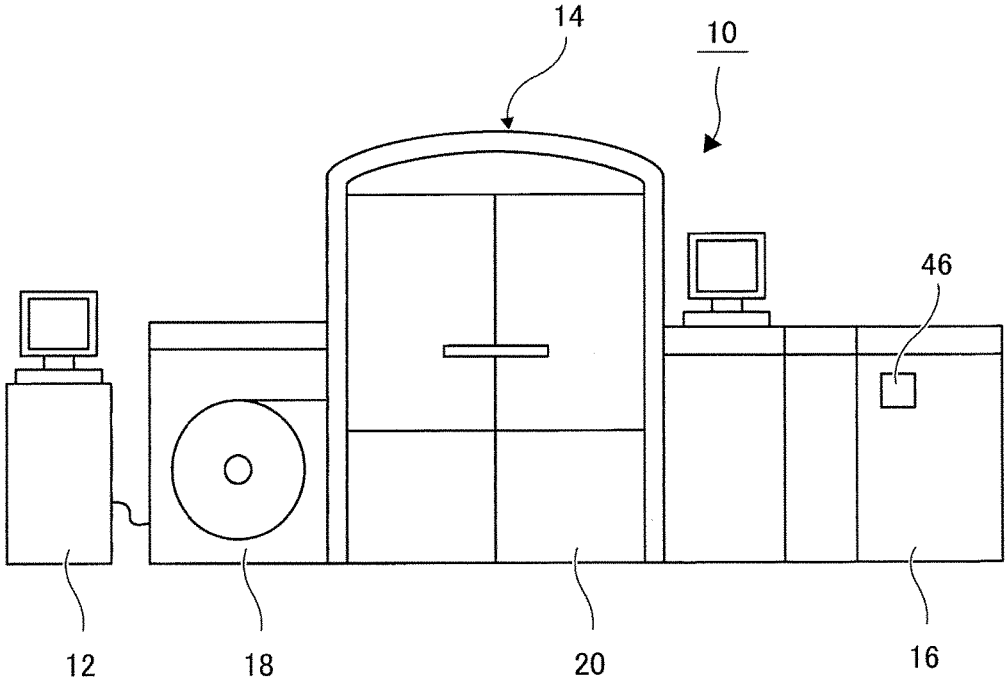
FIG. 1 is a diagram illustrating the configuration of an image forming apparatus according to an exemplary embodiment of the present invention.

An exemplary embodiment of the present invention will be described in detail by referring to the drawings.

FIG. 1 illustrates an image forming apparatus 10 according to the exemplary embodiment of the present invention.

The image forming apparatus 10 includes a server 12, an image forming section 14, and a post-processing unit 16 which are connected through a network.

The server 12 supplies the image forming section 14 with image data from which an image is to be formed, and controls the image forming section 14 and the post-processing unit 16.

The image forming section 14 includes a recording-medium supply unit 18 and an image forming section body 20.

The recording-medium supply unit 18 supplies the image forming section body 20, for example, with continuous form paper wound into a roll as a recording medium.

Figure 2:
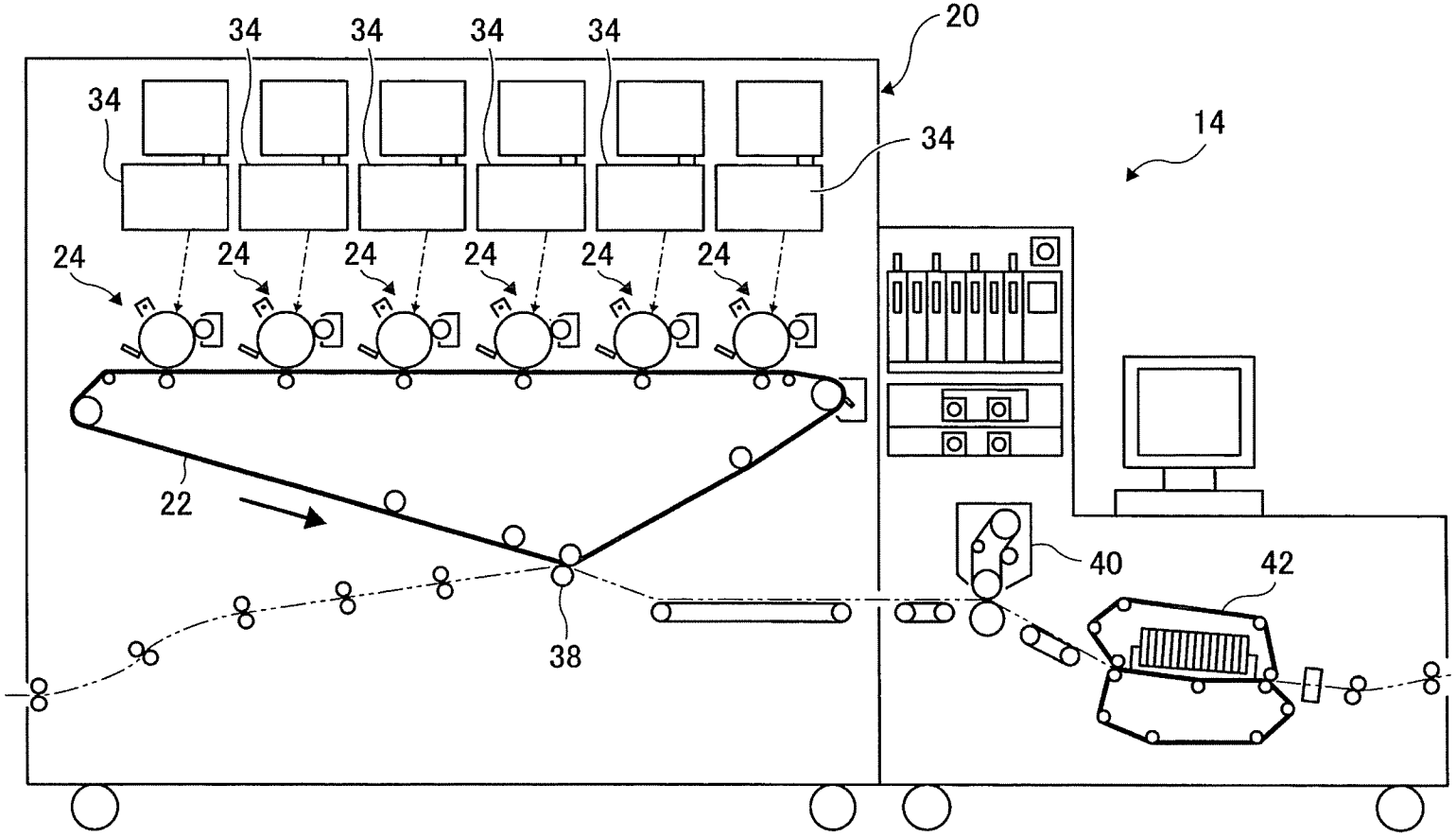
FIG. 2 is a sectional view of an image forming section used in the exemplary embodiment of the present invention.

The image forming section body 20 has the configuration, for example, illustrated in FIG. 2.

That is, the image forming section body 20 includes an intermediate transfer belt 22. For example, six image forming units 24 are provided on the intermediate transfer belt 22. The image forming units 24 form images by using toner selected from not only cyan, magenta, yellow, and black but also gold, silver, transparent color, white, and the like which are special colors.

Figure 3:
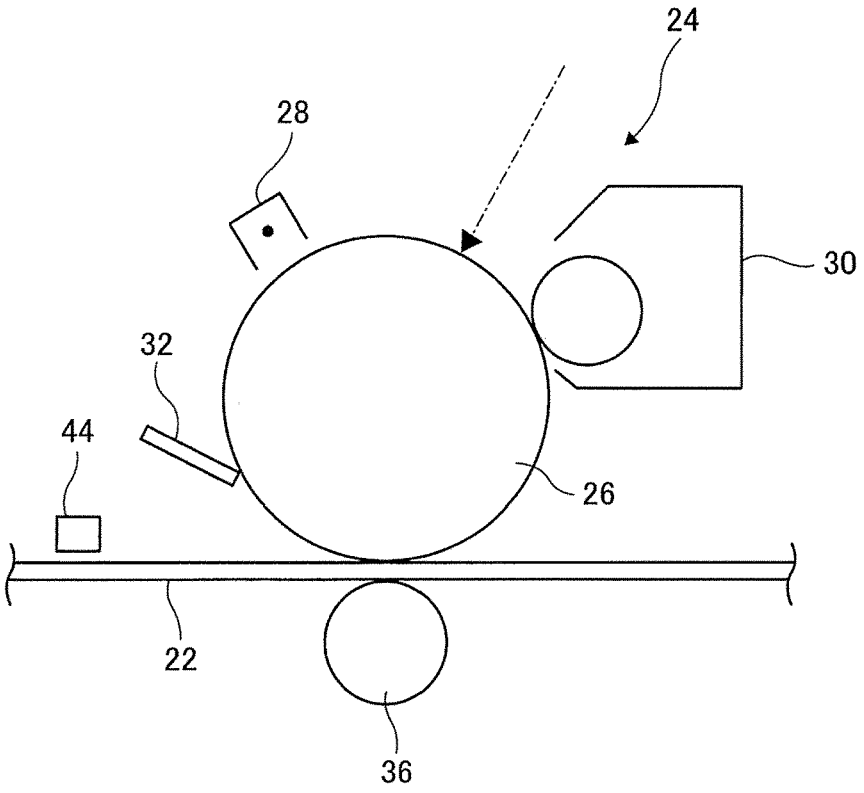
FIG. 3 is a sectional view of an image forming unit used in the exemplary embodiment of the present invention.

As illustrated in FIG. 3, each of the image forming units 24 which is, for example, a xerography system includes a photoreceptor drum 26, a charging device 28 that serves as a charging unit charging the surface of the photoreceptor drum 26 uniformly, a developing device 30 that develops an electrostatic latent image formed on the photoreceptor drum 26, and a cleaning device 32. The photoreceptor drum 26 which is a cylindrical image carrier that carries a toner image (developer image) is charged by the charging device 28 uniformly. On the photoreceptor drum 26, an electrostatic latent image is formed by using a laser beam emitted from an optical scanning device 34. The electrostatic latent image formed on the photoreceptor drum 26 is developed by the developing device 30 by using toner. A first transfer roller 36 is provided so as to face the photoreceptor drum 26 with the intermediate transfer belt 22 interposed between. A toner image developed by the developing device 30 is transferred onto the intermediate transfer belt 22 by using the first transfer roller 36. After the transfer of the toner image, remaining toner, paper dust, and the like attached to the photoreceptor drum 26 are removed by the cleaning device 32.

The toner image transferred onto the intermediate transfer belt 22 by the image forming unit 24 is subjected, by using a second transfer roller 38, to second transfer onto a recording medium supplied from the recording-medium supply unit 18. The recording medium onto which the image has been transferred is conveyed to a fixing unit 40, and the image is fixed, for example, through heat and pressure. The recording medium on which the image has been thus fixed is further cooled by a cooling unit 42.

As illustrated in FIG. 3, a first reading unit 44 is disposed, for example, downstream of the first transfer roller 36 so as to face the intermediate transfer belt 22. The first reading unit 44 which includes, for example, a light emitting device and a light receiving device reads a control pattern formed on the intermediate transfer belt 22.

The control pattern is a pattern for controlling the quality of an image formed by the image forming section 14, and the quality encompasses the gradation, misregistration, the density, and the like of the image.

In the exemplary embodiment, a control pattern transferred onto the intermediate transfer belt is read. Alternatively, a control pattern formed on the photoreceptor drum 26 may be read, or a control pattern transferred onto the continuous form paper may be read.

The post-processing unit 16 performs processing (post-processing) on the continuous form paper on which images are formed. Examples of post-processing include cutting of the continuous form paper, and a check of an image formed on the continuous form paper. The cutting may be performed by using a physical knife, or may be performed by using a laser. Examples of post-processing further include lamination of the continuous form paper and perforation of the continuous form paper.

The post-processing unit 16 is provided with a second reading unit 46. The second reading unit 46 reads a control pattern transferred onto the continuous form paper, and controls a post-processing execution time (timing) at which the post-processing unit 16 is activated. The post-processing execution time includes one of an execution start time, an execution interruption time, and an execution end time.

Figure 4:
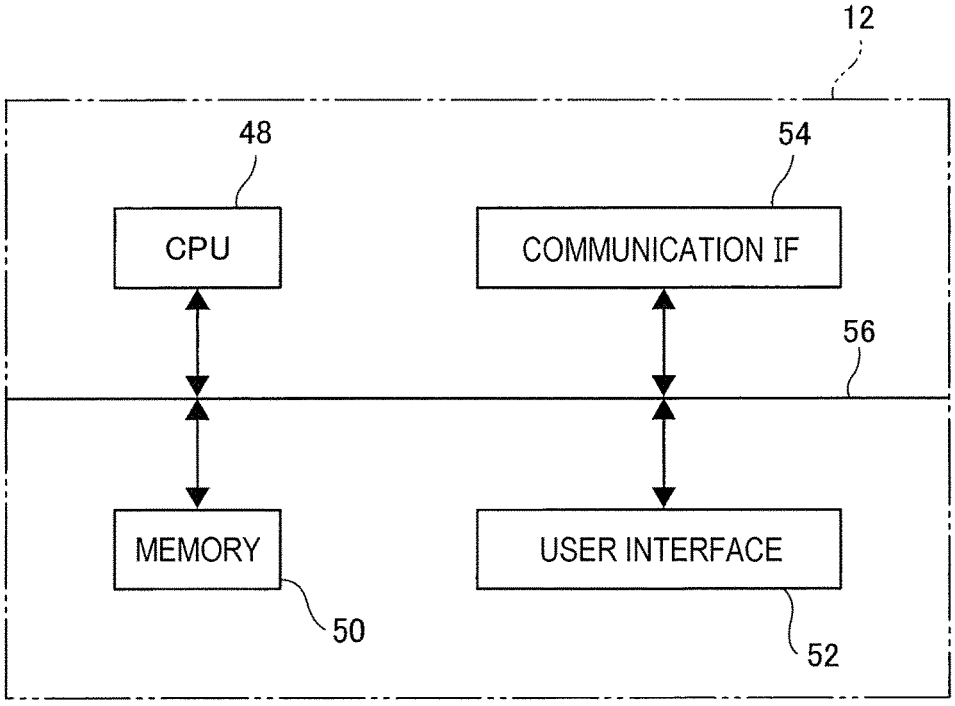
FIG. 4 is a block diagram illustrating the hardware configuration of a server according to the exemplary embodiment of the present invention.

As illustrated in FIG. 4, the server 12 described above includes a central processing unit (CPU) 48, a memory 50, a user interface 52, and a communication interface 54 which are connected through a control bus 56.

The CPU 48 performs a predetermined process on the basis of a control program stored in the memory 50. The user interface 52 is connected to a display (not illustrated) which displays a check result. The server 12 transmits an original image stored in the memory 50 to the image forming section 14, and controls the image forming section 14 and the post-processing unit 16.

In the exemplary embodiment, the image forming section 14 and the post-processing unit 16 are controlled by the server 12, but may be controlled by another control device.

Figure 5:
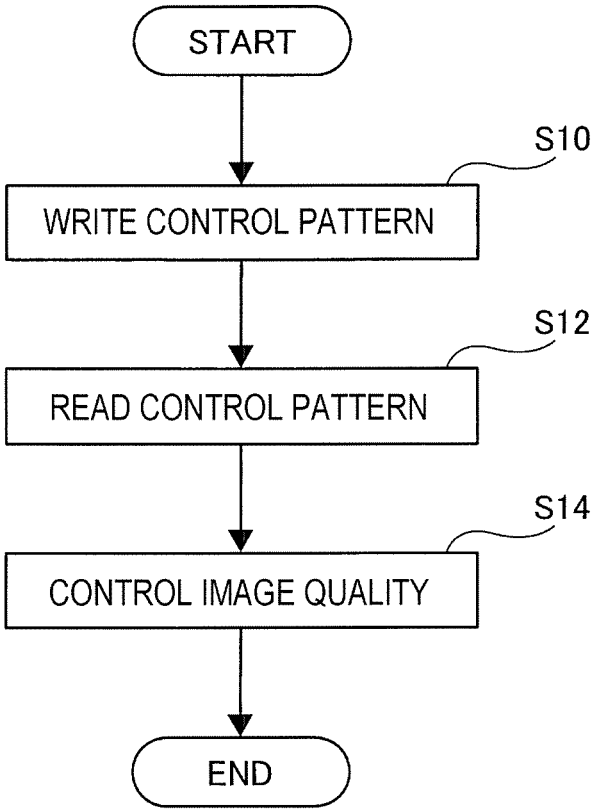
FIG. 5 is a flowchart of controlling the image forming section according to the exemplary embodiment of the present invention.

FIG. 5 is a flowchart for controlling the image forming section 14 operated by the CPU 48 of the server 12.

In step S10, an optical scanning device 34 writes a control pattern on the corresponding photoreceptor drum 26. The latent image of a control pattern formed on the photoreceptor drum 26 is developed by the developing device 30, and is subjected to first transfer onto the intermediate transfer belt 22. In the next step S12, the control pattern subjected to first transfer onto the intermediate transfer belt 22 is read by the corresponding first reading unit 44. In the next step S14, the quality of an image formed by the image forming section 14 is controlled on the basis of the control pattern which is read in step S12, and the process ends.

Figure 6:
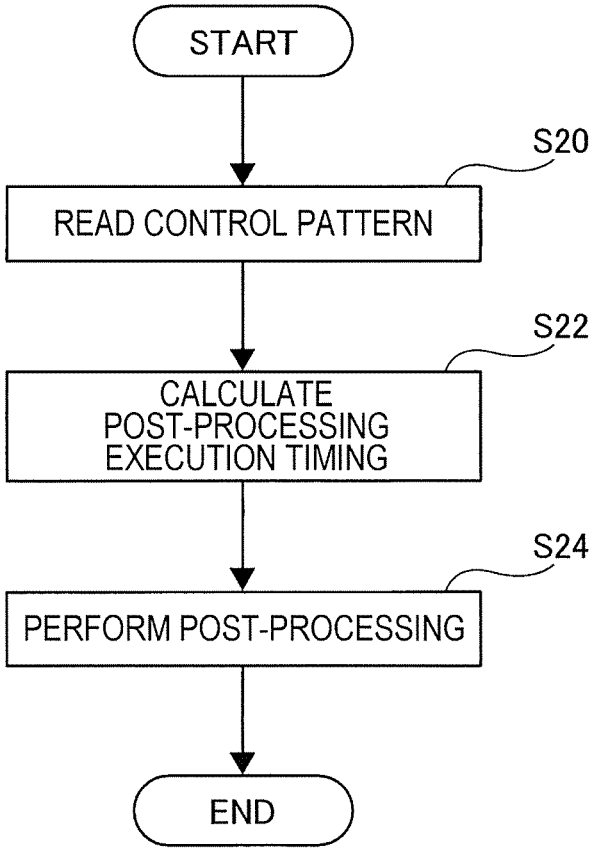
FIG. 6 is a flowchart of controlling a post-processing unit according to the exemplary embodiment of the present invention.

FIG. 6 is a flowchart for controlling the post-processing unit 16 operated by the CPU 48 of the server 12.

In step S20, the second reading unit 46 reads a control pattern formed on the continuous form paper. In the next step S22, a post-processing execution time (post-processing execution timing) is calculated on the basis of the control pattern which is read in step S20. In the next step S24, processing is performed in accordance with the post-processing execution timing calculated in step S22, and the process ends.

Execution of the control causes a control pattern to be used in not only control of the image forming section 14 but also control of a post-processing execution time.

Figure 7:
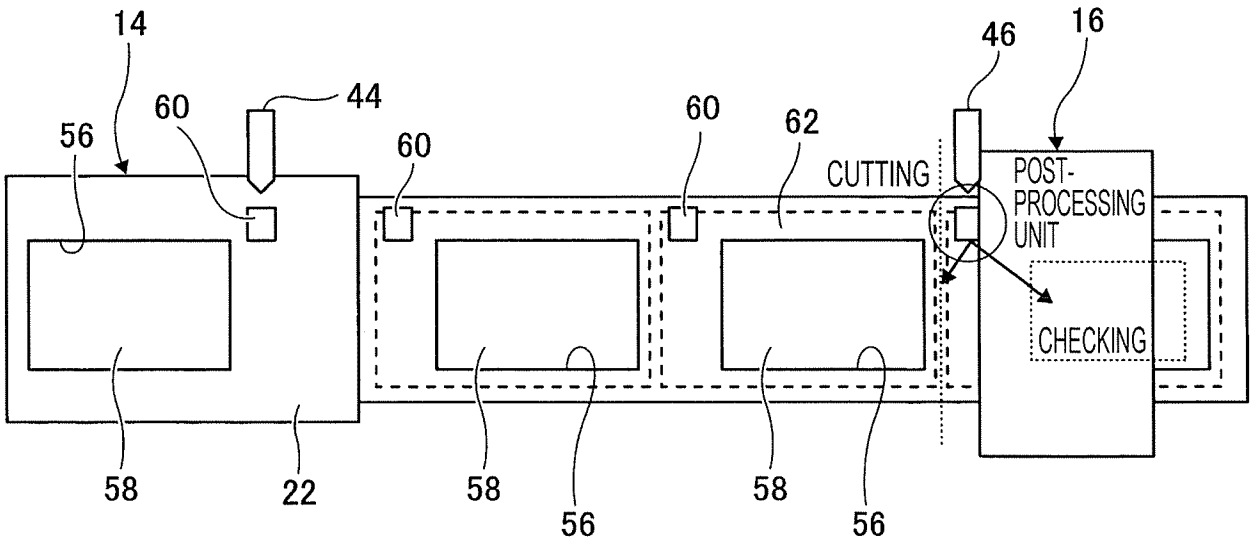
FIG. 7 is a diagram for describing a first concrete example according to the exemplary embodiment of the present invention.

FIG. 7 illustrates a first concrete example.

In addition to a print image 58 that is a toner image formed in a use region 56, a control pattern 60 that is also a toner image is formed on the intermediate transfer belt 22. The control pattern 60 which is used, for example, for gradation control is read by a first reading unit 44, and is used in order that the image forming section 14 controls the density or gradation of a formed image. The print image 58 and the control pattern 60 are transferred onto continuous form paper 62, and are further fixed. A control pattern 60 is formed, for example, on each page. A page indicates a unit (region) in which a continuous image may be formed. For example, a region in which image formation may be inhibited is present between pages. A control pattern 60 is formed in a non-use region. That is, in the first concrete example, a control pattern 60 is positioned between use regions 56 adjacent to each other in the conveying direction of the continuous form paper 62. In the orthogonal direction to the conveying direction of the continuous form paper 62, the control pattern 60 is positioned outside the use region 56. The control pattern 60 may be formed so as to be misaligned with the use region 56 in one of the conveying direction of the continuous form paper 62 and the orthogonal direction to the conveying direction.

The post-processing unit 16 is provided with the second reading unit 46 which reads a control pattern 60 printed on the continuous form paper 62. Reading of a control pattern 60 causes cutting of the continuous form paper 62 or checking of a print image 58 formed on the continuous form paper 62. The second reading unit 46 is provided for the post-processing unit 16. As long as the second reading unit 46 reads a fixed control pattern 60, any configuration may be employed. For example, the second reading unit 46 may be provided for the image forming section 14, or may be provided between the image forming section 14 and the post-processing unit 16. Further, the second reading unit 46 may be provided for a cutter in the post-processing unit 16. In addition, the second reading unit 46 may be a so-called line sensor in which reading devices are aligned in the orthogonal direction to the conveying direction of the continuous form paper 62, or may be an optical sensor that reads a control pattern 60 at a spot.

Figure 8:
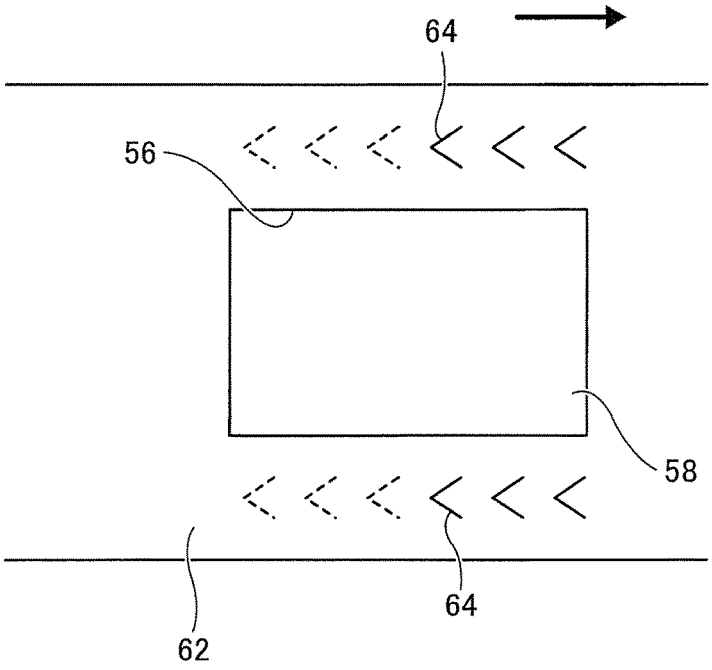
FIG. 8 is a diagram, for description, which illustrates a modified example of the first concrete example according to the exemplary embodiment of the present invention and which illustrates control patterns for controlling misregistration.
Figure 9:
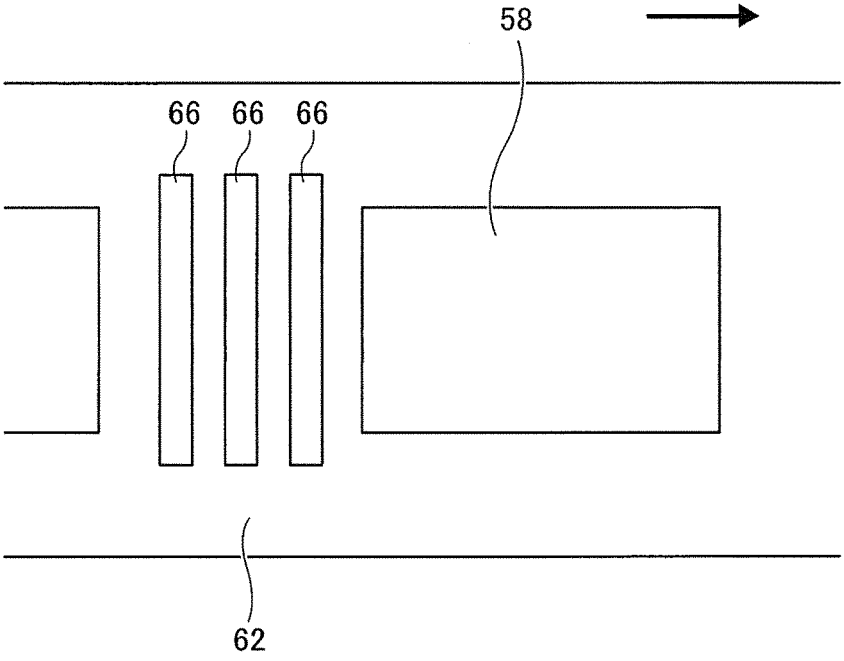
FIG. 9 is a diagram, for description, which illustrates a modified example of the first concrete example according to the exemplary embodiment of the present invention and which illustrates control patterns that are toner bands.

As illustrated in FIG. 8, not only a control pattern for density/gradation control as described above, but also control patterns 64 for registration correction may be used. A control pattern 64 for registration correction is formed, for example, for each color on the both ends in the orthogonal direction to the direction in which the intermediate transfer belt 22 travels, and is read to detect misregistration of the intermediate transfer belt 22 and the like. As illustrated in FIG. 9, control patterns 66 that are toner bands formed for prevention of peeling of a member or for suppression of toner stress may be used instead of control pattern 64. The control patterns 66 are formed, for example, between use regions 56 (a so-called inter-image) so as to discharge toner.

A processing timing will be described.

Figure 10:
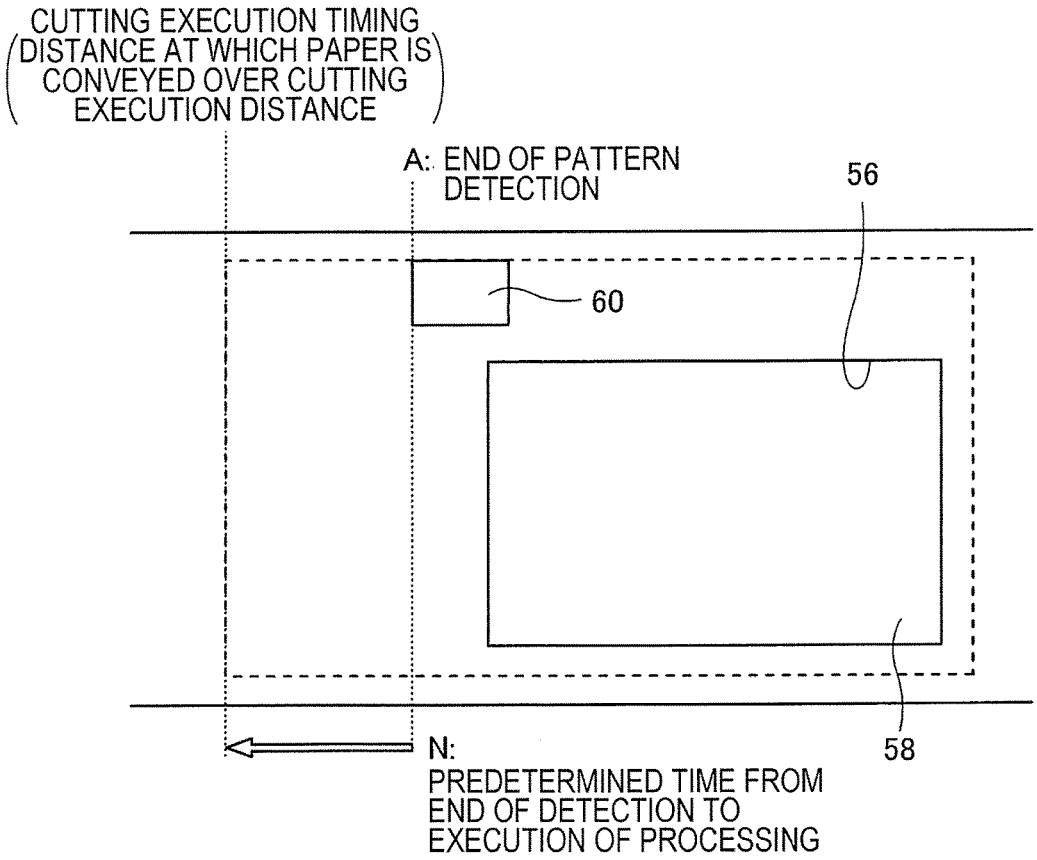
FIG. 10 is a diagram for describing a cutting execution timing in the first concrete example according to the exemplary embodiment of the present invention.
Figure 11:
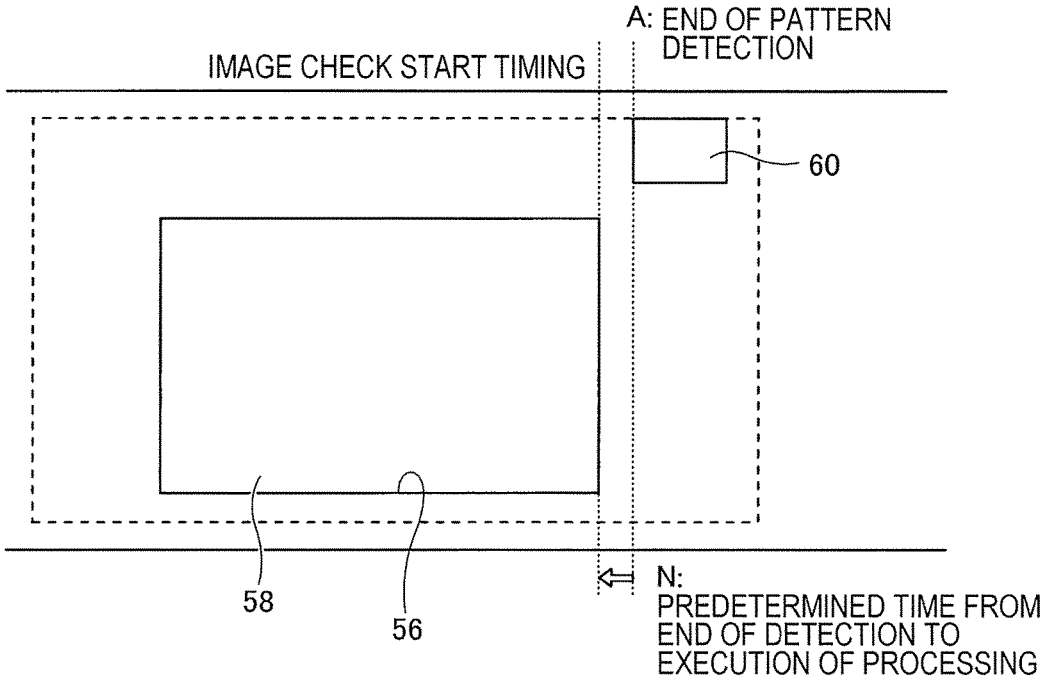
FIG. 11 is a diagram for describing a cutting execution timing in the first concrete example according to the exemplary embodiment of the present invention.

FIGS. 10 and 11 are diagrams for describing a case in which a control pattern 60 is read so that post-processing is performed.

For example, A point which indicates the trailing end of the control pattern 60 is used as a reference, and processing time is controlled so that post-processing is performed at a time point at which a predetermined time N has elapsed. If the paper is to be stopped due to cutting or the like, a conveyance time for the conveyance distance from the trailing end A point of the control pattern 60 is calculated. After the conveyance time has elapsed, the conveyance process is stopped, and the paper is cut. The reference may be, not the trailing end of a control pattern 60, but the leading end of a control pattern 60. Instead, the leading end and the trailing end may be detected, and the point obtained by dividing the distance between the leading end and the trailing end by using a predetermined ratio may be used as the reference. In FIG. 11, an image check start time is determined. Alternatively, an image check end time may be determined.

Figure 12:
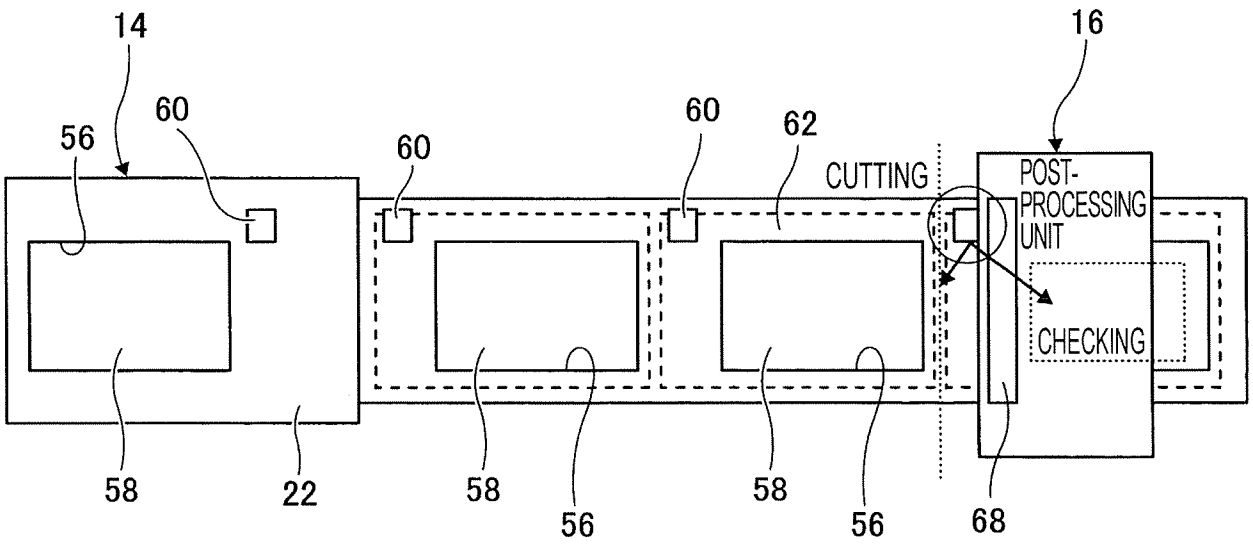
FIG. 12 is a diagram for describing a second concrete example according to the exemplary embodiment of the present invention.

FIG. 12 illustrates a second concrete example.

In the second concrete example, compared with the above-described first concrete example, the first reading unit 44 provided in the first concrete example is omitted, and a reading unit 68 provided for the post-processing unit 16 also controls the image forming section 14.

In this configuration, the reading unit 68 included in the post-processing unit 14 is also used to control the image forming section 14. Therefore, it is not necessary for the image forming section 14 to read a control pattern 60, resulting in reduction in the number of components and reduction in cost. The reading unit 68 may further serve as a reading unit for checking.

The reading unit 68 may be a so-called line sensor in which reading devices are aligned in the orthogonal direction to the conveying direction of the continuous form paper 62, or may be an optical sensor which reads a control pattern 60 at a spot. When the post-processing unit 16 is a cutter, a simple configuration in which an optical sensor for spot reading is provided for the cutter causes a control pattern for controlling the image forming section 14 to be read.

A control pattern 60 may be not only black having a density of 100% (so-called solid black) but also a color image or a halftone image. When a control pattern 60 is a halftone image, toner consumption is reduced compared with a solid image, achieving an effect on cost.

In the case of a control pattern 60 for density control, assume that a page in which the control pattern 60 is not formed in a good condition, for example, due to some defective image formation (for example, a control pattern having a lower density than a predetermined density, or formation of no control patterns), and from which a control pattern fails to be detected is found. At that time, an image formation abnormality is also highly likely to occur in a regular print image. In this case, an abnormality is to be detected also by the image forming section 14, and a stop operation or an abnormality addressing process corresponding to the stop operation is to be performed. However, when the post-processing unit 16 fails to detect a control pattern after a predetermined interval or more, execution of a process in which, for example, the image forming section 14 is stopped ensures suppression in increase of defective paper.

Figure 13:
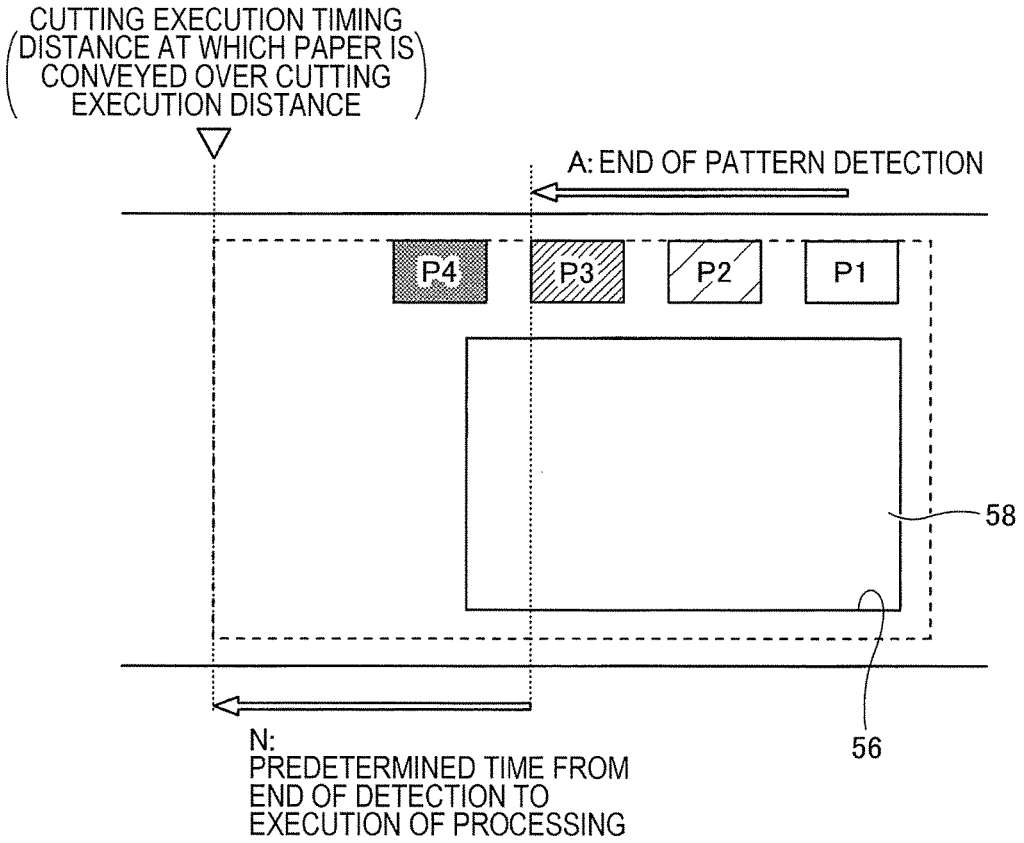
FIG. 13 is a diagram for describing a third concrete example according to the exemplary embodiment of the present invention.
Figure 14:
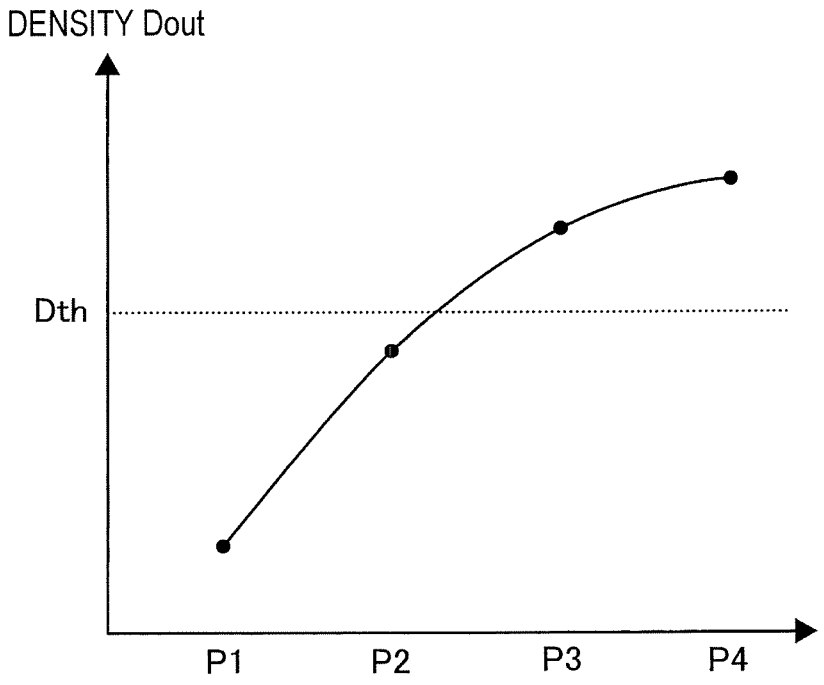
FIG. 14 is a diagram for describing a post-processing timing in the third concrete example according to the exemplary embodiment of the present invention.

FIGS. 13 and 14 illustrate a third concrete example.

Control patterns 60 (P1 to P4) are used for gradation control, and the density gradually increases from P1 to P4. Assume that the control pattern P3 which satisfies Dout≥Dth is detected. The symbol Dout represents a density value (for example, or a color value of the color space L*a*b*) with which a control pattern 60 is detected, and the symbol Dth represents a predetermined threshold. In this case, the trailing end of the control pattern P3 is used as the reference point A, and the timing of post-processing is controlled. Thus, even when multiple control patterns of multiple gradations are formed in the conveying direction in the same page, the timing of post-processing is correctly controlled.

Only control patterns of a specific color may be used. The color is determined by using reflected spectral light, and the control patterns for control of post-processing are specified. Thus, control timing in a page is determined.

When timing control is performed by determining the density/chromaticity or the color type as described above, multiple control patterns are not necessarily present in a single page. For example, when only a single-color pattern or a single-gradation pattern is formed per page because an area in which a control pattern is formed is restricted, a system in which a control pattern is formed by changing the patch color sequentially for travelling pages may be sometimes employed. In image control using this system, when a control pattern is repeatedly changed (in the density or the color characteristic value) for every few pages, a pattern of a specific color or a pattern having a predetermined density or more is formed on every few pages. Therefore, for example, the processing execution time of post-processing is controlled at predetermined page intervals. Thus, multiple pages are regarded as a single set, and the processing execution time, which corresponds to the set, of post-processing on a recording medium is controlled. For example, when an image check is performed as post-processing, the image check is performed, not per page, at predetermined page intervals.

Figure 15:
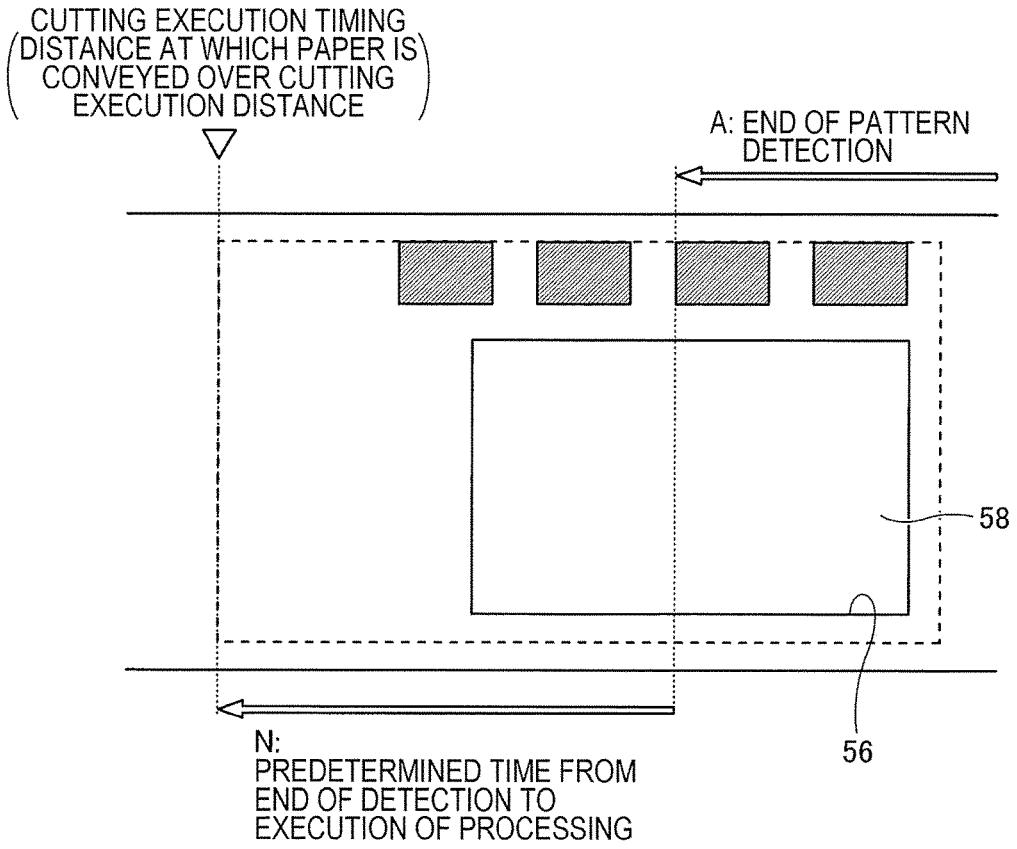
FIG. 15 is a diagram for describing a fourth concrete example according to the exemplary embodiment of the present invention.
Figure 16:
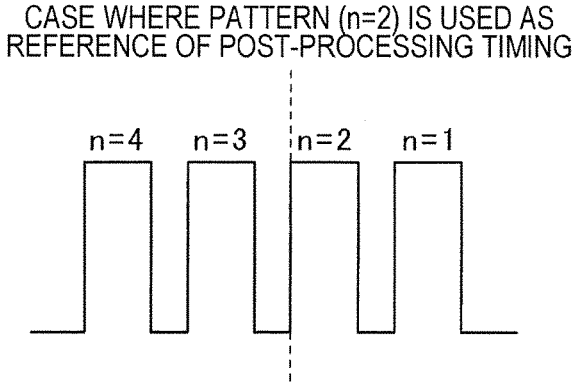
FIG. 16 is a diagram for describing a post-processing timing in the fourth concrete example according to the exemplary embodiment of the present invention.

FIGS. 15 and 16 illustrate a fourth concrete example.

When multiple control patterns 60 (n=1, n=2, n=3, n=4) are formed in the conveying direction in the same page, for example, the trailing end of the second control pattern 60 (n=2) among the control patterns 60 (n=1, n=2, n=3, n=4) is used as the reference point A, and the timing of post-processing is controlled. In this case, similarly to the third concrete example, the timing control using multiple patterns in a single page is performed. In addition, similarly to the third concrete example, multiple control patterns 60 are not necessarily present in a single page. In this case, for example, the processing execution time of post-processing is controlled at predetermined page intervals.

In the description of the above-described exemplary embodiment, a xerography system is used as an image forming section. The present invention is not limited to this. For example, an inkjet system may be used. In addition, continuous form paper is used as a recording medium. The present invention is not limited to this. Cut sheets may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image on a recording medium;

a post-processing unit that processes the recording medium obtained after the image forming section forms the image; and a controller that controls a post-processing execution time of the post-processing unit on a basis of information obtained by reading at least one control pattern from the recording medium, the at least one control pattern being formed to control the image forming section, wherein the controller uses the at least one control pattern as a reference of the post-processing execution time.

2. The image forming apparatus according to claim 1, wherein the at least one control pattern includes a plurality of control patterns which are read sequentially with the recording medium being conveyed, and wherein the controller uses a control pattern as the reference of the post-processing execution time, the control pattern satisfying a predetermined condition and being among the plurality of control patterns.

3. The image forming apparatus according to claim 2, wherein the plurality of control patterns are formed on a plurality of pages, and wherein the controller uses the control pattern as the reference of the post-processing execution time of processing, the control pattern satisfying the predetermined condition and being among the plurality of control patterns, the processing being performed for the plurality of pages by the post-processing unit on the recording medium.

4. The image forming apparatus according to claim 3, wherein each of the plurality of control patterns has a different density or a different color characteristic value, and wherein the controller uses the control pattern as the reference of the post-processing execution time, the control pattern satisfying the predetermined condition about the density or the color characteristic value and being among the plurality of control patterns.

5. The image forming apparatus according to claim 3, wherein the controller uses the control pattern as the reference of the post-processing execution time, the control pattern being an nth read control pattern among the plurality of control patterns, n indicating a predetermined natural number equal to or more than two.

6. The image forming apparatus according to claim 2, wherein each of the plurality of control patterns has a different density or a different color characteristic value, and wherein the controller uses the control pattern as the reference of the post-processing execution time, the control pattern satisfying the predetermined condition about the density or the color characteristic value and being among the plurality of control patterns.

7. The image forming apparatus according to claim 2, wherein the controller uses the control pattern as the reference of the post-processing execution time, the control pattern being an nth read control pattern among the plurality of control patterns, n indicating a predetermined natural number equal to or more than two.

8. The image forming apparatus according to claim 1, further comprising:

a reading section that reads the image formed by the image forming section.

9. The image forming apparatus according to claim 8, wherein the reading section includes a first reading unit and a second reading unit, the first reading unit reading a control pattern, the second reading unit reading an image in a use region.

10. The image forming apparatus according to claim 8, wherein the reading section includes a reading unit that reads a control pattern and an image in a use region.

11. The image forming apparatus according to claim 1, wherein the at least one control pattern is a pattern for controlling quality of the image formed by the image forming section.

12. The image forming apparatus according to claim 11, wherein the at least one control pattern is a pattern for controlling gradation of the image formed by the image forming section.

13. The image forming apparatus according to claim 11, wherein the at least one control pattern is a pattern for controlling misregistration of the image formed by the image forming section.

14. The image forming apparatus according to claim 11, wherein the at least one control pattern is a pattern for controlling density of the image formed by the image forming section.

15. The image forming apparatus according to claim 1, wherein the at least one control pattern is formed in a region other than a use region.

16. The image forming apparatus according to claim 15, wherein the at least one control pattern is formed in a region separated from the use region in an orthogonal direction to a conveying direction of the recording medium.

17. The image forming apparatus according to claim 15, wherein the at least one control pattern is formed between use regions in the conveying direction of the recording medium.

18. The image forming apparatus according to claim 1, wherein the recording medium is continuous form paper, and the post-processing unit cuts the continuous form paper.

19. The image forming apparatus according to claim 1, wherein the post-processing unit checks a use region.

20. A non-transitory computer readable medium storing a program causing a computer to execute a process, the process comprising:

forming an image on a recording medium;

processing the recording medium obtained after the image formation; and controlling a processing execution time of the processing on the recording medium, the controlling being performed on a basis of information obtained by reading a control pattern from the recording medium, the control pattern being formed to control the image formation, wherein the controller uses the control pattern as a reference of the post-processing execution time.

* * * * *